US009650772B2

(12) United States Patent
Lee et al.

(10) Patent No.: US 9,650,772 B2
(45) Date of Patent: May 16, 2017

(54) FLOAT LOCK FOR A FLUSH VALVE RESERVOIR

(71) Applicant: FLUIDMASTER, INC., San Juan Capistrano, CA (US)

(72) Inventors: Michael Lee, Zhongshan (CN); Kokon Zhang, Zhongshan (CN); JunSheng Chen, Xiamen (CN); Joseph Han, Irvine, CA (US)

(73) Assignee: FLUIDMASTER, INC., San Juan Capistrano, CA (US)

( * ) Notice: Subject to any disclaimer, the term of this patent is extended or adjusted under 35 U.S.C. 154(b) by 374 days.

(21) Appl. No.: 14/481,897

(22) Filed: Sep. 9, 2014

(65) Prior Publication Data

US 2015/0067955 A1 Mar. 12, 2015

Related U.S. Application Data

(60) Provisional application No. 61/875,575, filed on Sep. 9, 2013.

(51) Int. Cl.

| | |
|---|---|
| ***E03D 1/14*** | (2006.01) |
| ***E03D 1/00*** | (2006.01) |
| ***E03D 1/35*** | (2006.01) |

(52) U.S. Cl.

CPC ..... *E03D 1/144* (2013.01); *E03D 1/35* (2013.01); *Y10T 29/49947* (2015.01)

(58) Field of Classification Search

CPC ..... E03D 1/144

USPC ..... 4/324, 415

See application file for complete search history.

(56) References Cited

U.S. PATENT DOCUMENTS

| | | | | |
|---|---|---|---|---|
| 2001/0042265 | A1* | 11/2001 | Han | E03D 1/142 4/325 |
| 2002/0134432 | A1 | 9/2002 | Li et al. | |
| 2008/0295238 | A1* | 12/2008 | Hawley | E03D 1/144 4/325 |
| 2009/0025129 | A1 | 1/2009 | Le et al. | |
| 2012/0260412 | A1 | 10/2012 | Vargas et al. | |

OTHER PUBLICATIONS

PCT/ISA/US; International Search Report (PCT Article 18 and Rules 43 and 44) of PCT/US2014/054862; Nov. 20, 2014; pp. 1,2; PCT/ISA/US, Alexandria, Virginia.

* cited by examiner

*Primary Examiner* — Christine Skubinna

(74) *Attorney, Agent, or Firm* — Gordon Rees Scully Mansukhani LLP; David R. Heckadon

(57) ABSTRACT

A flush valve system may comprise a rail guide configured to extend between upper and lower portions of the flush valve system in a toilet tank. A float may be slidably coupled to the rail guide and be configured to be received by a reservoir associated with the float. The float may comprise a closed upper surface with a mating pocket and one or more circumferential walls extending from the closed upper surface. A lock mechanism may be slidably received by the mating pocket of the float. The lock mechanism may comprise one or more bias arms to fixedly engage the lock mechanism to the float and one or more locking members to fixedly engage the lock mechanism to the rail guide.

16 Claims, 16 Drawing Sheets

FLOAT LOCK FOR A FLUSH VALVE RESERVOIR

CROSS-REFERENCE TO RELATED APPLICATIONS

This application claims priority to U.S. provisional patent application 61/875,575 entitled "Dual flush valve float lock" and filed Sep. 9, 2013, the contents of which are incorporated herein by reference in its entirety as if set forth verbatim.

FIELD

The present embodiments relate generally to toilet flush valves and particularly to refill for dual flush valves.

BACKGROUND

The present disclosure relates to toilet flush valves configured to impart multiple flush types (e.g. dual flush) from a toilet tank into a toilet bowl. For purposes of discussion, a toilet tank typically has a flush valve assembly that is forced opened and remains opened until a predetermined volume of liquid flows from the tank into the toilet bowl through the flush valve assembly. Liquid is supplied to the toilet tank through a fill valve from a liquid supply line to the toilet tank. In practice, the fill valve opens when the fluid level in the tank falls below a predetermined liquid level.

Flush valve assemblies typically include a flush valve, a float and an actuation mechanism. The actuation mechanism causes the flush valve to open and release liquids stored in the tank into the toilet bowl and close when the float reaches a predetermined liquid level in the tank. For a dual flush valve, the toilet bowl may be refilled with liquids during the time the fill valve fills the toilet tank. The predetermined volume of liquid that refills the toilet bowl is sufficient to seal off the trap way of the bowl. In practice this predetermined volume amount may be defined as ratio of the total liquid volume supplied by the fill valve during a particular flush cycle. The fill valve feeds the liquids and feeds them to the tank bowl.

Toilets that can impart dual flushes have been found to be particularly advantageous in several situations. Specifically, prior to initiating a flush, a user may choose between a large flush water volume for solid waste (e.g. a full flush) or a smaller flush water volume for liquid waste (e.g. a partial flush). This may be done via a switch, button or the like on the actuation mechanism.

In general, dual flush valves (shown in FIG. 2) may be equipped with a flush volume controlling device associated with a flush volume, a drain opening lock, and full and partial flush control devices in order to maximize the volume of respective full and partial flushes. Full and partial flush control devices are typically adjustable to maximize respective flush volumes. Typically, a dual flush canister valve typically has a bottom reservoir that holds or retains a flush float therein. Further, a pair of adjustable height floats may be provided with the dual flush canister valve. One float is associated with a full flush and the other float is associated with a half flush.

The actual volume of a flush corresponds to an adjustable height at which each of the respective floats are set (e.g. set by the manufacturer). OEM toilet manufacturers may preset the height of a respective float in order to comply with relevant code such as the U.S. Environmental Protection Agency's "Water Sense". However, if the end-user is capable of altering or otherwise modifying the float height, this risks violating the relevant code since the resultant flush volume associated with a respective float. Further, being able to modify relevant float settings risks performance efficiency of a given flush valve assembly and thus waste of resources in the long run.

Accordingly, there is a need to resolve this problem so that end users are prevented from altering float settings.

SUMMARY

The following simplified summary is provided in order to disclose a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

To prevent end users from altering factory float settings, a lock mechanism and associated slide rails is coupled to one or more mating pockets of a respective float in a dual float flush assembly. The lock mechanism may comprise teeth or projections with bias arms (e.g. spring fingers). In practice, the flush valve assembly comprising the described lock mechanism can adjust the float settings up and down on relative to the associated slide rail between fixed positions. To disengage the lacking mechanism from a fixed position on the slide rail, the lock mechanism can be pressed or pushed towards the slide rail thereby disengaging the teeth or projections of the lock mechanism from the slide rail. Disengaging the lock mechanism in turn allows the associated float to slide up and down along the slide rail.

In other embodiments, the bias arms of the lock mechanism can engage in one or more fixed positions on the slide rail by using associated tabs. In practice, when the bias arms are engaged and thus the lock mechanism is maintained in a fixed position on the slide rail, the tab is forced into a groove or ridge on the slide rail thereby locking the float against the slide rail.

In some embodiments, a lock mechanism may comprise one or more biased arms with corresponding spring-action and corresponding locking members, wherein each arm is configured to push against a corresponding float and the corresponding locking member pushes against the rail. Pushing the lock mechanism in this manner allows the float to be slidably positioned at a desired location on the rail. In turn, to fix the lock mechanism and corresponding float in place, the bias arms are engaged by forcing the locking teeth into the grooves of the rail thereby locking the float against the rail.

In other embodiments, a flush valve system as described herein comprises a rail guide configured to extend between upper and lower portions of the flush valve system. A float is provided that slidably attaches to the rail guide and is configured to be received by a reservoir also on the rail guide. The float may comprise a closed upper surface with a mating pocket and one or more circumferential walls extending from the closed upper surface towards the upper portion of the toilet tank. A lock mechanism may be slidably received by the mating pocket of the float. The lock mechanism may comprise one or more bias arms to fixedly engage the lock mechanism to the float and one or more locking members to fixedly engage the lock mechanism to the rail guide.

When the lock mechanism is received by the float, the lock mechanism may be slidable along the rail guide between one or more fixed positions. Further, the rail guide may further comprise a first plurality of ridges or notches so that the height of the float with respect to the rail guide is adjustable by sliding the float along the first plurality of ridges or notches.

The rail guide may further comprise a second plurality of ridges or notches so that a height adjustment guide of the mating pocket removably attaches to the first plurality of ridges or notches when sliding the float along the first plurality of ridges or notches. In this respect, the one or more locking members of the lock mechanism fixedly engages with the rail guide.

one or more ridges or grooves onto which the one or more members fixedly engages with the rail guide. In this embodiment, each of the one or more bias arms may further comprise a bias force so that the lock mechanism and the float are fixedly engaged when the one or more bias arms are moved until the bias force causes the one or more bias arms to communicate with a tab of the float. In this respect, each of the one or more bias arms flexes inwardly or outwardly when communicating with the tab. Similarly, each of the one or more bias arms may further comprise a latch surface that communicates with the tab.

The lock mechanism in some embodiments may further comprise an external surface opposite the rail guide, wherein the lock mechanism may also be configured so that a predetermined pushing force externally applied to the external surface fixedly engages the lock mechanism with the tab. Further, the lock mechanism may be slidable along the rail guide prior to being fixedly engaged with the float but after being received by the mating pocket of the float.

In other embodiments, the bias arm may be arranged so that a predetermined force externally applied to the bias arm fixedly engages and/or disengages the lock mechanism with the float or rail guide. Said predetermined force may be substantially normal to the closed upper surface of the float and may be applied using a tool.

Still in other embodiments, the lock mechanism may further comprise one or more guide slots corresponding to one or more lock mechanism guides of the mating pocket. In this respect, the lock mechanism guides of the mating pocket may be slidably inserted into the one or more guide slots of the lock mechanism when the lock mechanism is slidably received by the mating pocket.

Optionally, the lock mechanism may further comprise a rail engagement arm oriented substantially parallel with the rail guide to reinforce the fixed engagement of the lock mechanism to the rail guide. The rail engagement arm may comprise one or more locking surfaces disposed on a distal end of the rail engagement arm that communicate with the rail guide or the one or more ridges of the rail guide. The rail guide may also comprise a longitudinal slide axis. Each of the one or more ridges of the rail guide may also comprise an array of teeth or projections that extend outwardly from the rail guide to removably engage with the float, lock mechanism, or both. The array of teeth or projections may be snapped onto, disposed inside, or otherwise in communication with the float or lock mechanism when fixedly engaged.

In other embodiments, a method of maintaining a height of a float in a flush valve system in a toilet tank is also described. The method may include: slidably inserting a lock mechanism into a mating pocket of the float slidably coupled to a guide rail in the system, wherein the guide rail extends between lower and upper portions of the toilet tank; slidably positioning float along the guide rail until a predetermined height; and fixedly engaging the lock mechanism to the float and the guide rail. The predetermined height may correspond to a predetermined flush volume associated with the float.

The lock mechanism may fixedly engage with the float by flexibly moving the one or more bias arms until positioned underneath or in communication with corresponding tabs of the float.

The disclosed embodiments are particularly advantageous since it provides a locking feature that prevents factory float settings from being manipulated by an end user or the like. To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

At the same time, various elements of the device described herein may be slightly altered for various different features and various different or altered uses thereof, and these predicated changes and alterations are fully contemplated within the principles of the present disclosed improvements.

DETAILED DESCRIPTION

The device of the present disclosure may be economically molded by using one or more distinct parts to form the features and mechanisms disclosed herein which, when assembled together in an economical fashion, may form the device regardless of the particular form. Unless defined otherwise, all terms of art, notations and other scientific terms or terminology used herein have the same meaning as is commonly understood by one of ordinary skill in the art to which this invention belongs.

In some cases, terms with commonly understood meanings are defined herein for clarity and/or for ready reference, and the inclusion of such definitions herein should not necessarily be construed to represent a substantial difference over what is generally understood in the art. All patents, applications, published applications and other publications referred to herein are incorporated by reference in their entirety. If a definition set forth in this section is contrary to or otherwise inconsistent with a definition set forth in the patents, applications, published applications and other publications that are herein incorporated by reference, the definition set forth in this section prevails over the definition that is incorporated herein by reference.

As used herein, "a" or "an" means "at least one" or "one or more."

As used herein, the term "user", "subject", "end-user" or the like is not limited to a specific entity or person. For example, the term "user" may refer to a person who uses the systems and methods described herein, and frequently may be a field technician. However, this term is not limited to end users or technicians and thus encompasses a variety of persons who can use the disclosed systems and methods.

Figure 1:
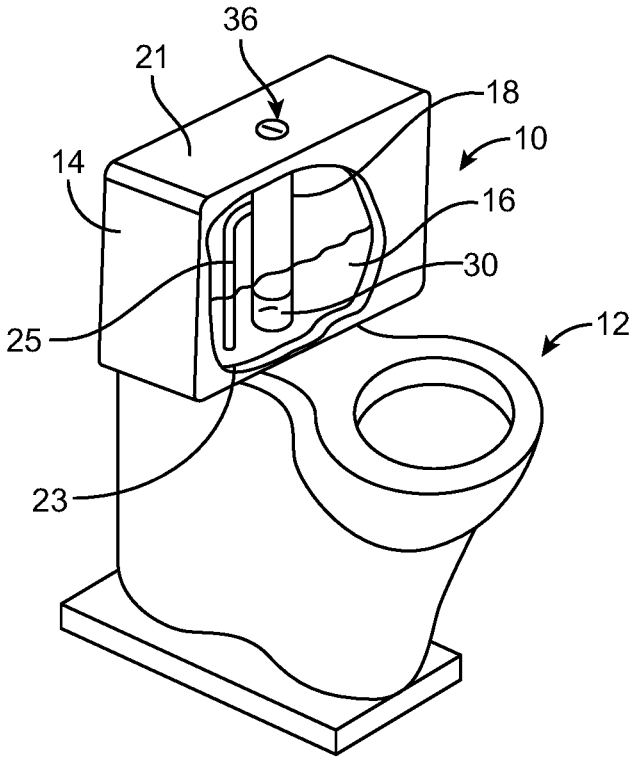
FIG. 1 is a perspective view of a toilet partially in phantom to illustrate a flush valve assembly of the present disclosure when installed in a toilet tank.

FIG. 1 depicts a conventional toilet 10 with a bowl 12 that receives liquid and solid waste. A toilet tank 14 is typically positioned above bowl 12 and comprises flush valve reservoir 28 for liquid 16 (e.g. water) that is used to flush bowl 12. A flush valve assembly 18 is seen operatively coupled between an upper 21 and lower 23 portion of tank 14.

Figure 2:
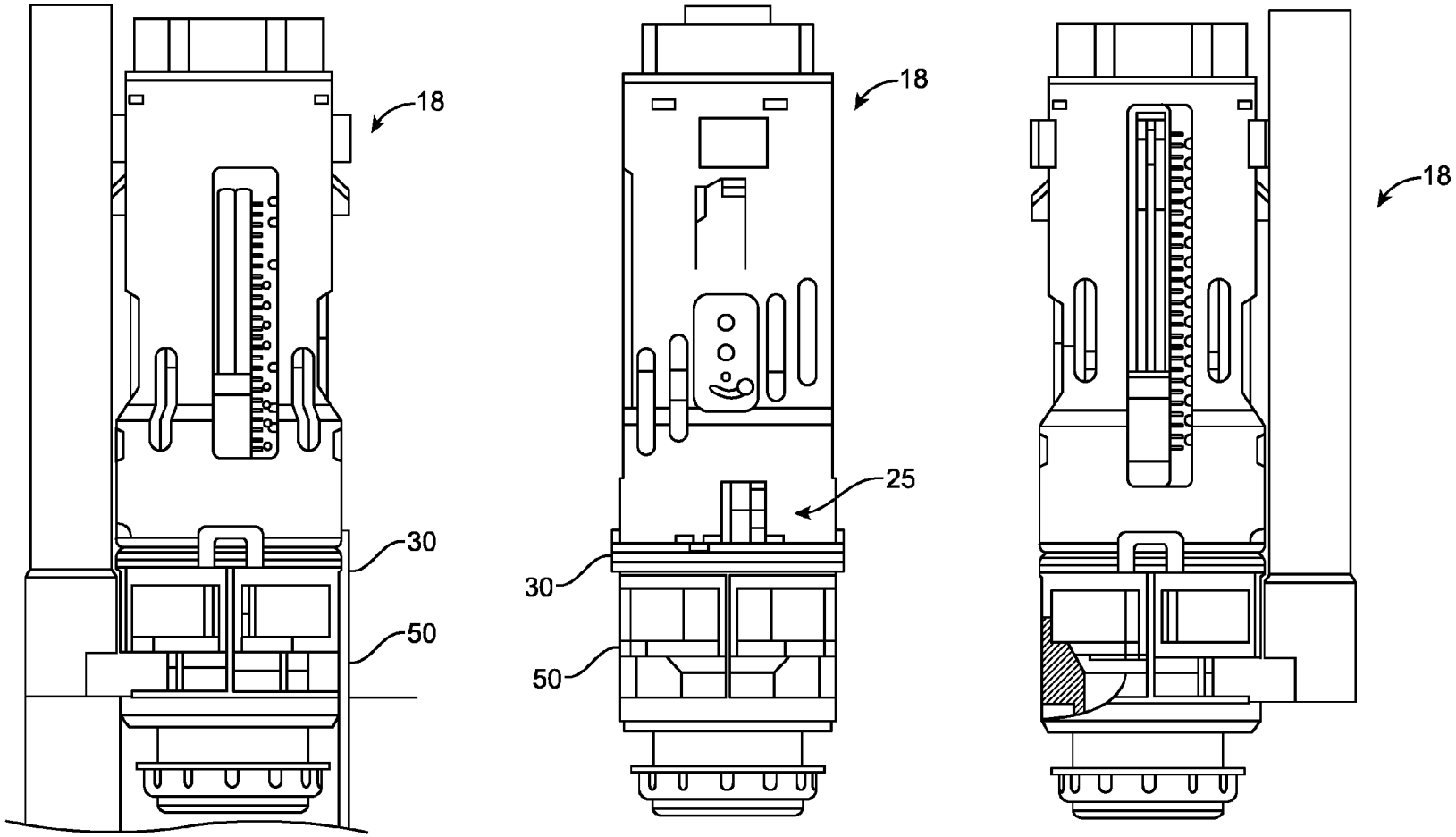
FIG. 2 is an illustration of an exemplary flush valve assembly.

FIG. 2 depicts several perspective views showing the different sides of the same embodiment of assembly 18 comprising reservoir 28 and float 10 (each not depicted in FIG. 2) with window 25. In practice, canister valves such as those in assembly 18 typically comprise said reservoir 28 with float 10. Reservoir 28 may have a closed lower surface with circumferential walls extending upwards and an open upper surface. In turn, float 10 is designed to be inserted into or received by reservoir 28, wherein float 10 may be designed with a closed upper surface and circumferential walls that extend downwards towards the closed lower surface of reservoir 28.

Figure 3:
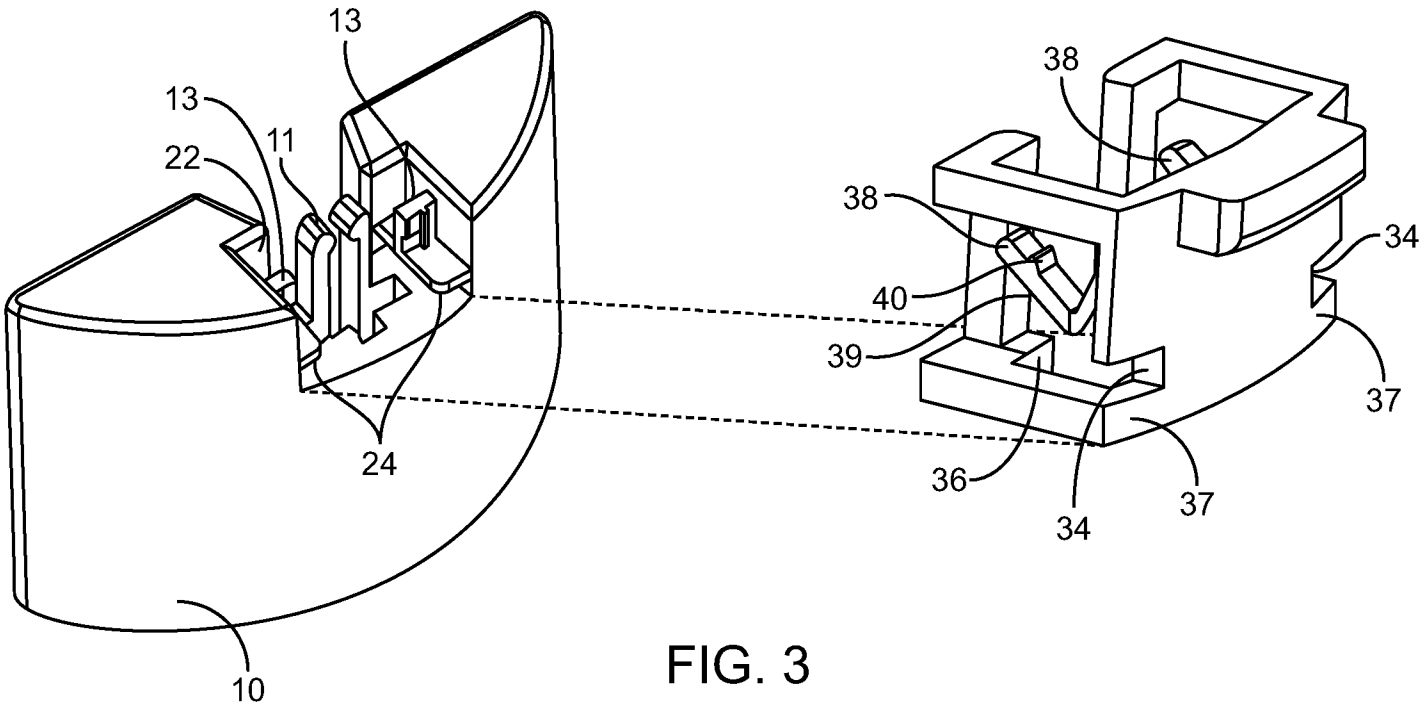
FIG. 3 depicts a perspective view of an exemplary float and lock mechanism in an exploded state prior to being assembled.

In order to lock the height settings of float 10 when installed with assembly 18, lock mechanism 35 is provided. FIG. 3 depicts an exploded view of lock mechanism 35, in this embodiment prior to being mechanically attached to float 10 and float rail guide 11. As can be seen, float 10 comprises at least one mating pocket 22 into which the body of mechanism 35 is slidably received. Pocket 22 may comprise slot guides 24, wherein the base 37 of mechanism 35 can be positioned and guided into proper position and oriented to properly engage with both float 10 and rail 55 as explained more particularly below.

Base 37 may comprise one or more slots (and projections) 34 that extend away from the central portion of lock mechanism 35 to form shoulders or sliding feet that correspond with guides 24 of float 10. Depending on needs or preference, float 10 may comprise only one guide 24 or may comprise any number of guides 24 to receive and guide slots 34 of base 37 of mechanism 35. In certain frequent embodiments, lock mechanism 35 engages with the slot 50 in pocket 22. In other embodiments, lock mechanism 35 is integral with float 10. In these other embodiments, the lock mechanism 35 often is comprised as a single piece with all or a portion of the float 10.

Mechanism 35 may further comprise one or more bias arms 39 and one or more locking members 36 disposed on or adjacent to the forward face of base 37. Each arm 39 may comprise a bias force so that when pushed against or otherwise moved, arm 39 flexes inwardly (or outwardly depending on orientation) but tends to return to its pre-flex position and orientation. In this respect, arm 39 may be constructed from a relatively resilient material configured to flex without fracturing or being permanently deformed.

In some embodiments, arm 39 may extend from the handling surface (opposite the forward face of base 37) and relatively downward relative to the center portion of mechanism 35 until ultimately angling back up again (see, e.g., the elbow joint of arm 39). As can be seen, mechanism 35 may slide into float 10 through guides 24 of pocket 22 until arm 39 passes corresponding receivers 13 of float 10 or until contacting ridges or grooves 57 of rail 55.

When a distal end 38 of arm 39 contacts a corresponding receiver 13 or groove 57 of rail 55, distal end 38 may flex inwardly until end 38 passes under and/or through groove 57 or passes under and/or through receiver 13 to fixedly engage mechanism 35 to float 10. Arm 39 may further comprise a latch surface 40 designed to snapped onto, etched on, disposed underneath or otherwise engaged with associated locking tab or projections of float 10 until latch surface 40 of arm 39 fixedly engages member 35 and associated float 10 (so that float 10 can no longer slide along rail 55).

Figure 4B:
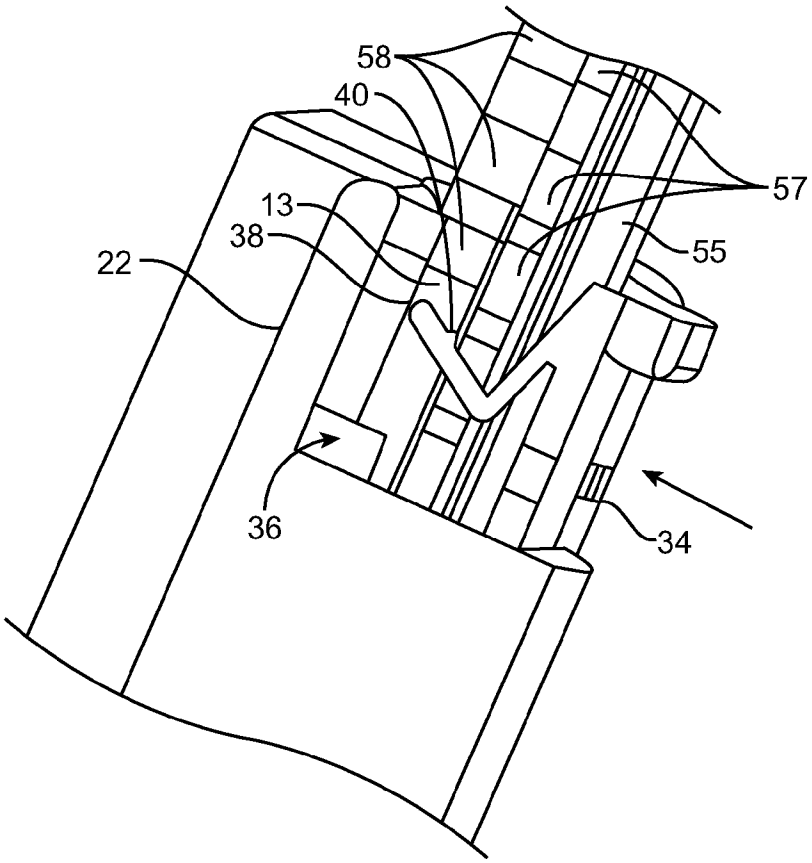
FIGS. 4A and 4B depict related exemplary perspective views of a lock mechanism when assembled with a float of the exemplary flush valve assembly of FIG. 2.
Figure 4A:
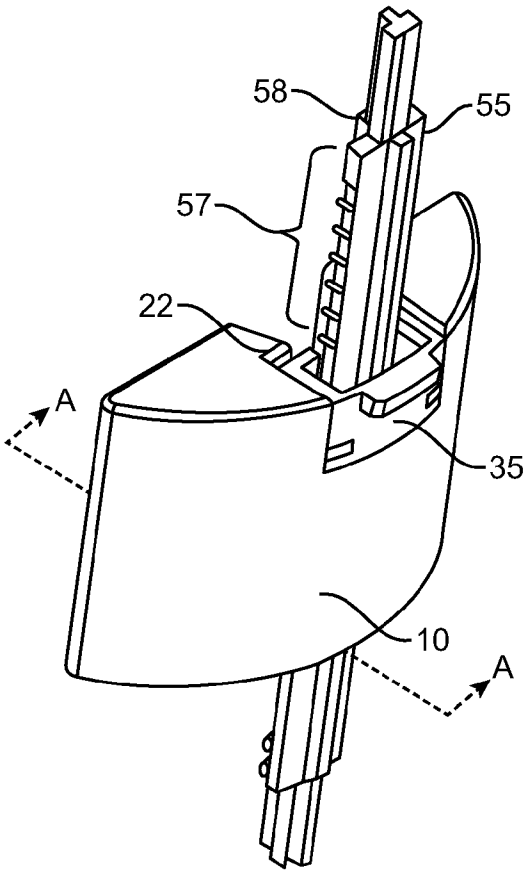

FIG. 4A depicts a perspective view of lock mechanism 35 when fixedly engaged with float 10 and rail 55 of assembly 18. FIG. 4B depicts a close-up perspective cross-section view of the embodiment of FIG. 4A along section A-A to more accurately depict how mechanism 35 assembles and ultimately fixedly engages with float 10 and rail 55. As described and depicted in FIG. 4B, float 10 is slidably coupled to rail 55 of assembly 18. In order to maintain float 10 in a fixed engagement so that corresponding float height settings of float 10 cannot be tampered with by an end-user or the like, mechanism 35 is slidably received by float 10 and rail 55. Specifically in both FIGS. 4A and 4B, mechanism 35 is slidably inserted into pocket 22 of float 10. Once slidably received, FIG. 4B more clearly depicts distal end 38 of arm 39 after contacting receiver 13 and/or projection of groove 57.

Rail 55 in this embodiment may comprise one or more elongate members configured to slidably receive and guide both float 10 and mechanism 35 when assembled together and in assembly 18 in toilet 10. As seen in FIG. 4A, rail 55 may comprise one or more grooves 57 with projections or notches positioned along the one or more elongate members of rail 55 with which guide 11 of float 10 can removably attach and arms 39 of mechanism 35 or member 36 can be fixedly engaged so that as arm 39 contacts float 10 and is caused to flex (inwardly or outwardly as required) to maneuver and pass by respective receiver 13 and/or groove 57 of rail 55, bias forces of arm 39 cause latch 40 to bias back to its pre-flex position and fixedly engage with float 10 and/or groove 57 at the desired location.

As such, the predetermined height setting of float 10 is maintained as required. Rail 55 may therefore comprise a vertical positioning groove 58 (see FIG. 17B) for vertical positioning of float 10 when assembled to rail 55. As can be seen in FIG. 17B, groove 58 may include one or an array of rear facing locking projections, members, tabs, or optionally receiving notches positioned on the aft face of rail 55. Grooves 58 may be designed to removably attach with guide 11 as float 10 slides between the one or more fixed positions on rail 55. Grooves 57 may be configured to fixedly engage the lock mechanism 35 with the float 10 and associated grooves 57 of rail 55.

When assembled together on rail 55, both mechanism 35 and float 10 may be slidably movable between one or more fixed positions along rail 55, the fixed positions being defined by notches, teeth, projections or the like of grooves 58 and/or 57. In some embodiments such as FIG. 4B, mechanism 35 can be disengaged after being fixedly engaged with float 10 and rail 55 by pushing the wall (see force arrow) towards rail 55. For example, in embodiments where member 36 is fixedly engaged with corresponding groove 57, pushing the external surface as described causes member 36 to move so that it no longer communicates with rail 55. Being disengaged, mechanism 35 with float 10 is now free to again slide along rail 55 until the required or desired height setting is achieved for float 10.

In other embodiments, once arms 39 are caused to flex inwardly and snap into proper orientation and position relative to float 10 and rail 55, mechanism 35 is fixedly engaged with float 10 so that the height setting of float 10 in accordance with relevant code.

Figure 5B:
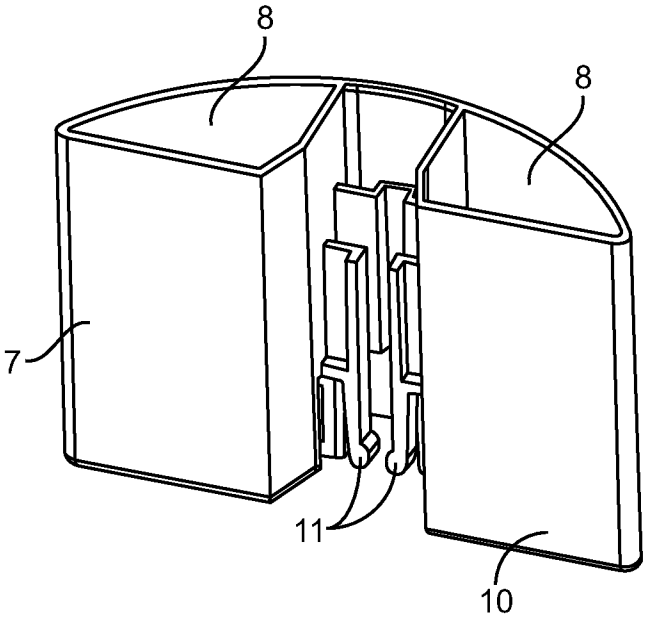
FIGS. 5A and 5B depict related exemplary perspective views of a float from the embodiment of FIG. 3.
Figure 5A:
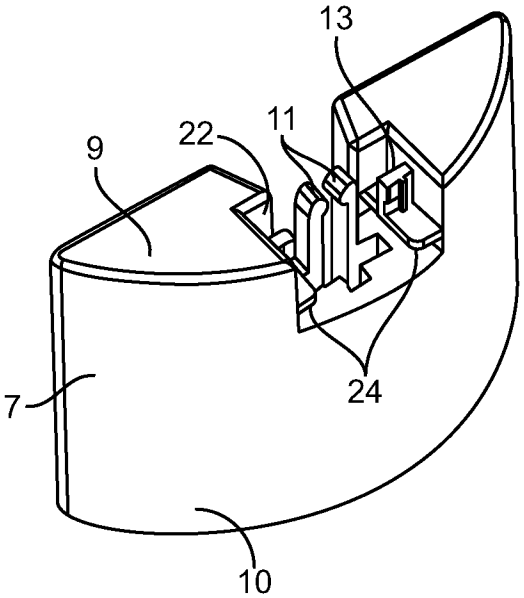

FIG. 5A depicts a perspective view of float 10 with closed, upper surface 9 facing upwards and circumferential walls 7 extending down towards reservoir 28 (not depicted). FIG. 5B depicts float 10 oriented somewhat differently so that its lower, open surface 8 is now facing upwards for illustrative purposes only. As previously described (and described more particularly below), guide 11 is configured to slidably receive and removably attach to projections or notches of grooves 58. Guide 11 may therefore comprise two or more corresponding coupling surfaces configured to bias towards each other and flex away from each other when being coupled to respective projection of groove 58.

Figure 6:
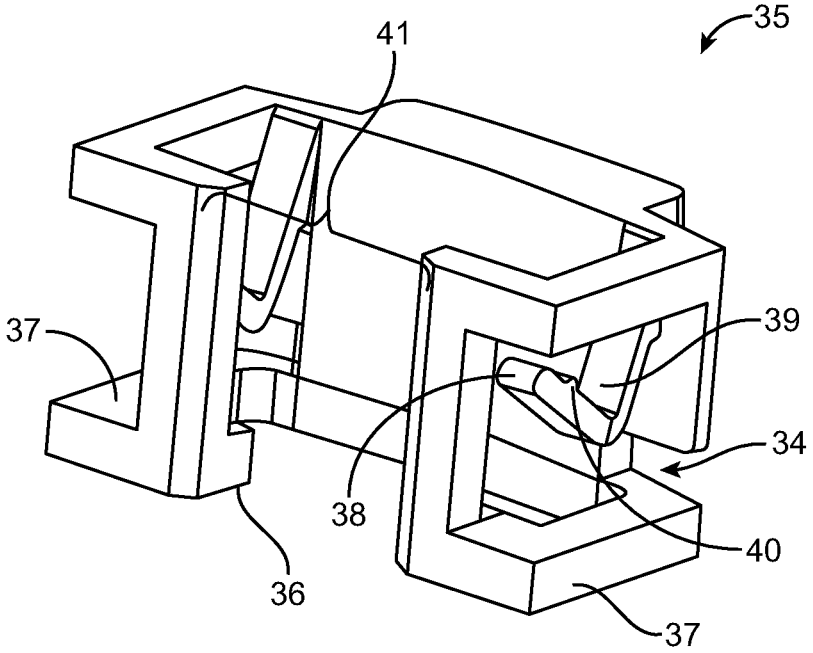
FIG. 6 depicts an exemplary perspective view of the lock mechanism of FIG. 3 with forward coupling face of the locking mechanism facing forward.

FIG. 6 depicts a perspective view of mechanism 35 with the forward, mating surface of mechanism 35 oriented forward (i.e. the face that is inserted into pocket 22 of float 10). As can be seen, each of arms 39 of mechanism 35 are more clearly depicted as well as their respective shape and design which causes each to flex down and inwardly when passing and contacting groove 57 of rail 55. Further, FIG. 6 clearly depicts latch 40 which is a projection that extends outwardly from arm 39 to removably couple latch 40 to corresponding receiver 13 or tab 4 of float 10.

Further, mechanism 35 further comprises guide receiving window 41 defined between two opposing edges of mechanism 35 disposed on the forward mating surface. Window 41 is configured so that guide 11 can pass therethrough as mechanism 35 is slidably received by pocket 22. It should be further mentioned that members 36 (e.g. locking members, teeth, projection, or the like) are positioned adjacent or near the forward mating surface of mechanism 35 and window 41 substantially parallel with base 37. As can be seen, when arms 39 are fixedly engaged in a locked position as seen in FIG. 4, latches 40 which may be locking teeth, tabs, members, projections or the like are forced into receiver 13, tab 4 or the like of float 10 and one or more members 36 are in communication with grooves 57 of rail 55 thereby locking the height of float 10 with respect to rail 55.

Figure 7:
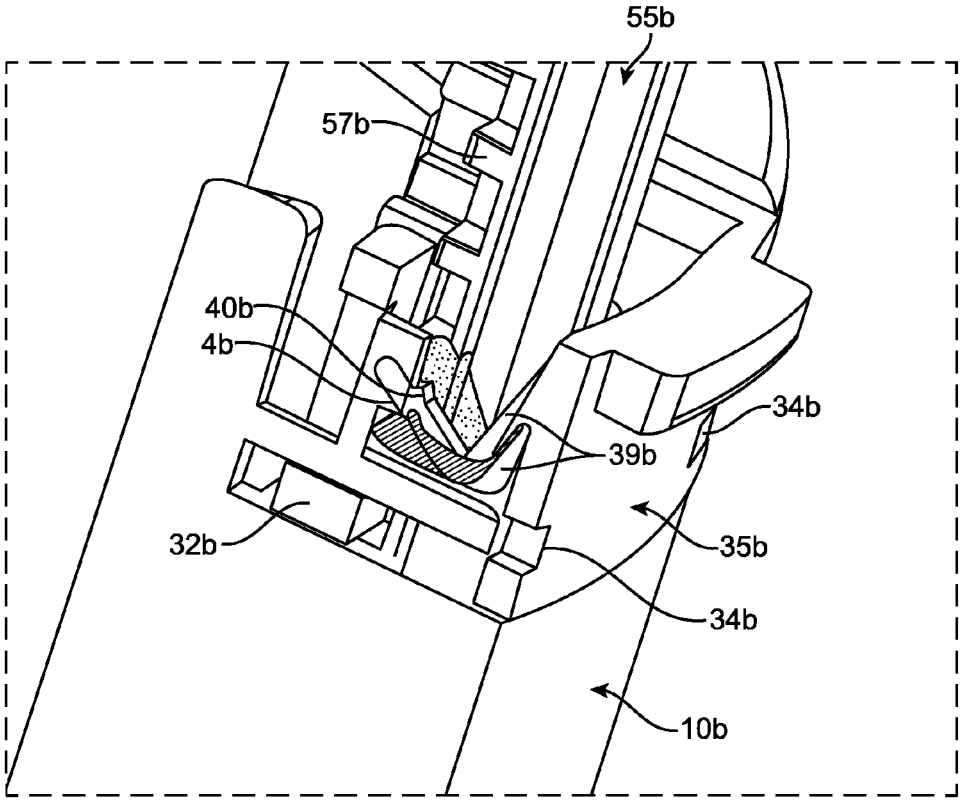
FIG. 7 depicts a perspective cross-section view of a lock mechanism when coupled to a float illustrating how the internal features of each interact when in an assembled position, a locked position, and a free position.

FIG. 7 depicts a slightly modified embodiment of those previously described in FIGS. 1-6. Specifically, FIG. 7 depicts a cross-section perspective view of mechanism 35*b*, float 10*b*, and rail 55*b* when coupled with each other along a cross section that passes through slot 34*b* so that interconnection of arm 39*b* of mechanism 35*b* and tab 4 between an assembled position (i.e. pre-fixed engagement), a free position, and a fixedly engaged position is observable. As can be seen, in an assembled position, slots 34*b* of mechanism 35*b* have slid through guides 24*b* of float 10*b* to position and thus orient mechanism 35*b* properly with float 10*b*. In a free position, mechanism 35*b* is similarly able to slide freely with float 10*b* along rail 55*b* between positions until a desired height of float 10*b* is obtained. In order to maintain the desired height, mechanism 35*b* fixedly engages float 10*b* by causing arm 39*b* to flex and contact tab 4*b*. In this respect, it is understood that arm 39*b* flexes inwardly towards slot 34*b* until distal end 38*b* fixedly engages with tab 4*b* of float 10*b*.

Furthermore, to maintain the desired height of float 10*b* with respect to guide 55*b*, locking projections or teeth 32*b* of mechanism 35*b* communicate with groove or projection 57*b* by being seated upon, coupling, or otherwise contacting each other so that tooth 32*b* is incapable of moving passed projection 57*b*. In this respect, lock mechanism 35*b* effectively fixedly engages float 10*b* to its desired position on rail 55*b* ensuring that associated assembly 18 is code compliant.

In this respect, bias arm 39*b*, similar to bias arm 39 and all other bias arms described herein, may be constructed and shaped with a lower elbow bend that extends from the upper portion of mechanism 35*b* towards float 10*b* when assembled. Arms 39*b* (and all other similarly described arms herein) may be constructed from substantially resilient yet flexible material(s) so that bias arms associated with any of the lock mechanisms described herein are capable of flexing as required for the respective engagement scheme.

Figure 8B:
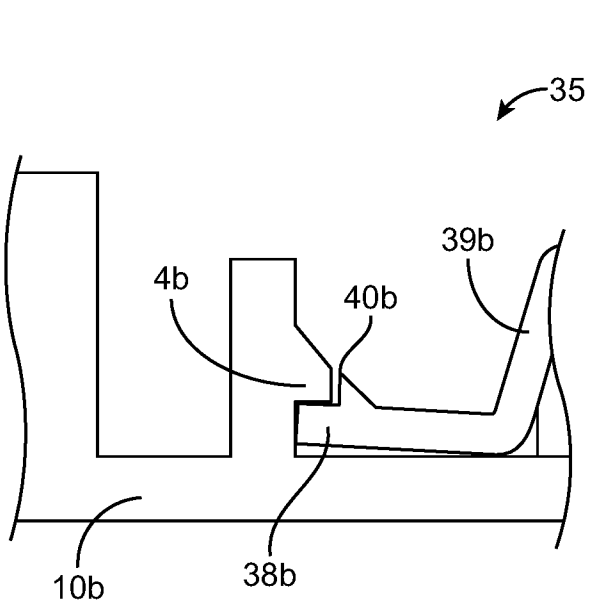
FIGS. 8A and 8B depict a side cross-sectional view of the bias arms of the lock mechanism of FIG. 7 being adjusted and removable locked with the float.
Figure 8A:
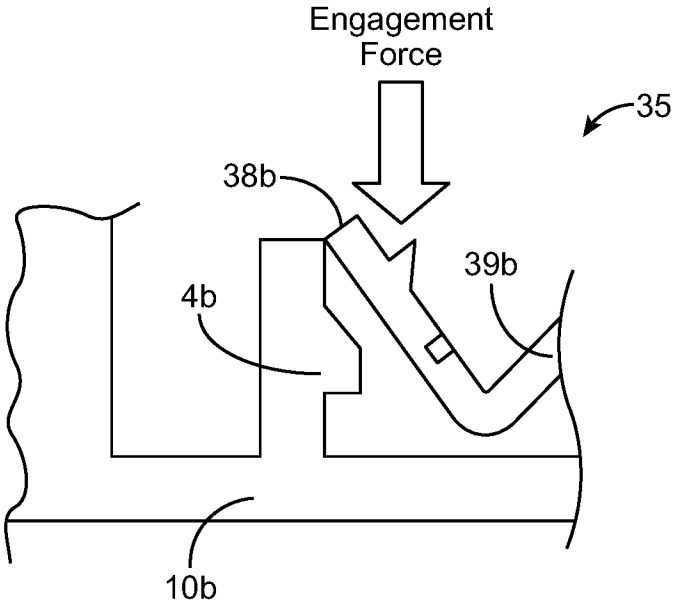

FIGS. 8A and 8B depict related cross section views of the embodiments of FIG. 7 to more clearly depict the mating relationship between tab 4*b* of float 10*b* and arm 39*b* of mechanism 35*b*. Movement of float 10*b* with respect to mechanism 35*b* and rail 55*b* is prevented when tabs 4*b* fixedly engage arm 39*b* as can be seen. Specifically, FIG. 8A depicts mechanism 35*b* and float 10*b* when the height of float 10*b* can be still adjusted along rail 55*b*. By contrast, FIG. 8*b* depicts float 10*b* in a fixed position wherein arm 39*b* has been caused to flex inwardly so that end 38*b* is positioned underneath tab 4*b* and in communication with latch 40*b* and end 38*b*. When using the embodiments of FIGS. 8A and 8B and moving between the assembled state of FIG. 8A and the fixed engagement state of FIG. 8B, one or more forces substantially normal to closed surface 22*b* of float 10 should be delivered in accordance with the downward arrow of FIG. 8A so that end 38*b* of arm 39*b* flexes as required. Said force(s) may not necessarily be normal to closed surface 22*b* but must be sufficient to cause arm 39*b* to flex until being positioned as depicted in FIG. 8*b*. Further, said force(s) may be applied through a tool similar to the force arrow of FIG. 8A.

It should be noted that the designation "b" associated with the embodiments of FIGS. 7-8 is intended to describe similar previously described features of the embodiments of FIGS. 3-6 but with slight modifications specific to the embodiments described of FIGS. 7-8.

Figure 9A:
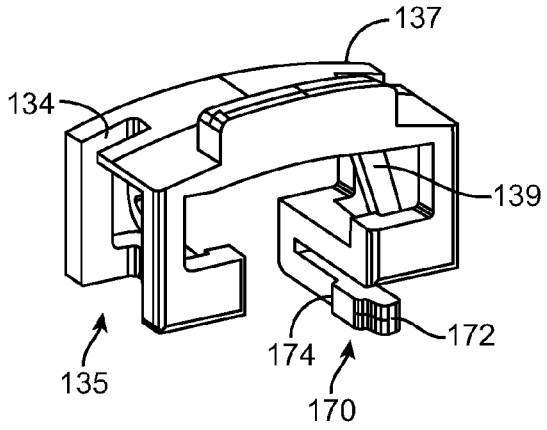
FIGS. 9A, 9B, and 9C depict related perspective views of another lock mechanism.
Figure 9B:
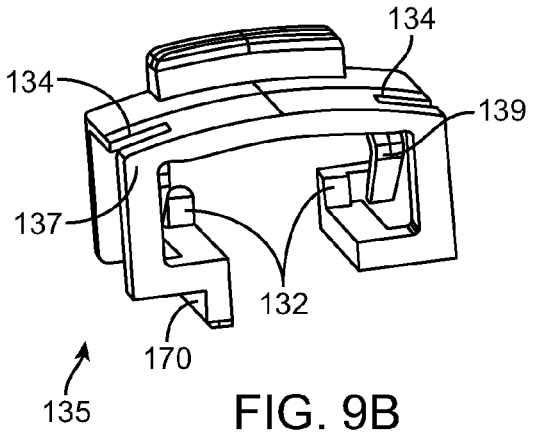
Figure 9C:
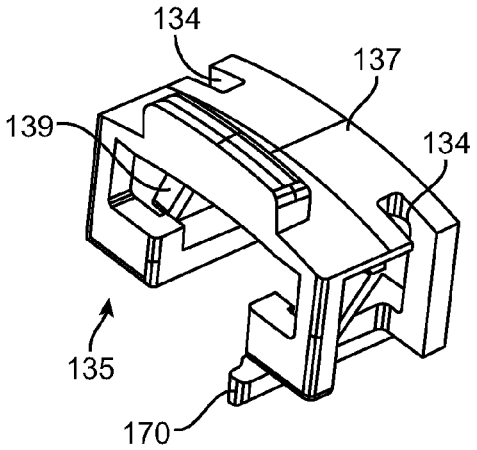

FIGS. 9A, 9B and 9C depict related perspective views of an alternative lock mechanism 135 that is configured to be slidably received by float 110 and rail 155 in flush valve assembly 118 (each not depicted in FIGS. 9A, 9B, and 9C but similarly designed with previously described floats and guides) and fixedly engage the height settings associated with corresponding float 110 once installed on rail 155. In this embodiment, mechanism 135 still comprises bias arms 139 but also comprises additional detent arm 170 for slidably engaging with rail 155. For purposes of understanding, base 137 in all three FIGS. 9A through 9C is depicted in various orientations but when assembled with float 110 and rail 155, base 137 would be seated adjacent to the lower surface of mating pocket 122 (similar to pocket 22) of float 110. As can be seen, arm 170 is configured to slidably engage with projections of rail 155 when rail 155 is slid underneath corresponding pocket, space, gap, or void defined between arm 170 and mechanism 135. Further, arm 170 may further comprise two locking lever surfaces, 172 and 174, disposed on its distal end and configured to engage with associated float 110.

Similar to previously described embodiments, mechanism 135 is slidably received by float 110 through pocket 122. Once assembled and float 110 has been positioned along rail 155 at its desired height setting, mechanism 135 may fixedly engage float 110 on rail 155 by flexing arms 139 into its fixed position with respect to tab 104. Locking lever surfaces 172 and 174 of arm 170 may also be engaged with float 110 to further reinforce the fixed engagement of float 110 with respect to rail 155. Accordingly, arm 170 is an additional feature through which mechanism 135 can securely engage float 110 with rail 155 by providing an additional, distinct fastening point above float 110.

Figure 10C:
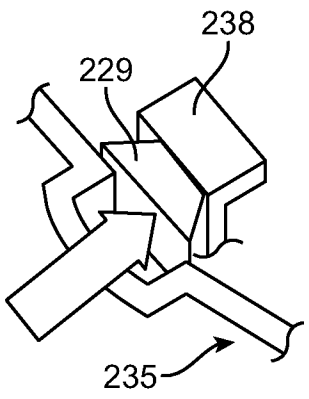
FIGS. 10A, 10B, and 10C depict related perspective views of another lock mechanism.
Figure 10B:
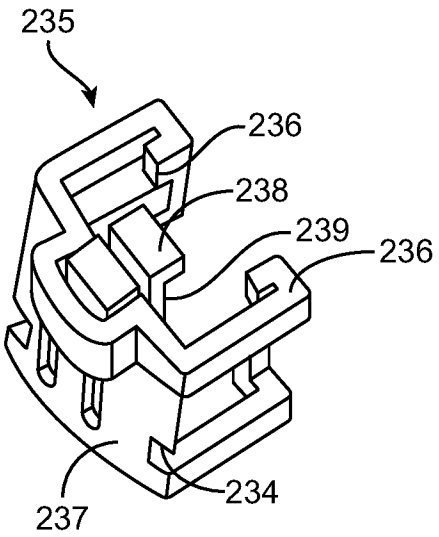
Figure 10A:
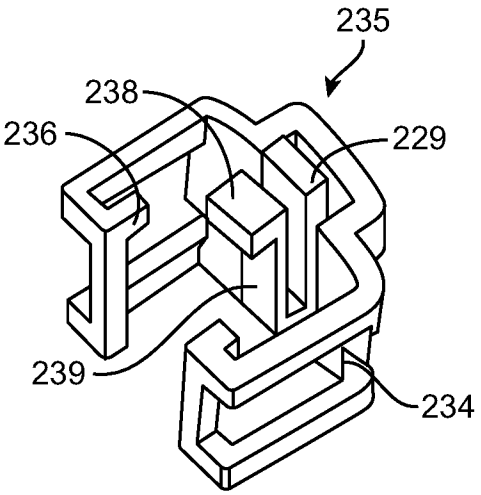

FIGS. 10A, 10B, and 10C depict related perspective views of another locking mechanism 235. In this embodiment, mechanism 235 is configured to be slidably received by pockets 222 of float 210 that is slidably coupled to rail guide 255 (each not depicted but similar in design and scope to previously described floats and guides). Mechanism 235 differs from mechanism 35 with respect to how bias arm 239 fixedly engage the height of float 210. Instead of providing arms 39 that fixedly engage mechanism 35 with float 10 as previously described, arm 239 instead forms an elbow or bend with a substantially more acute angle than elbow of arm 39 to ultimately engage directly with grooves 257 of rail 255 on the side of rail 255 opposite the locking members 236 (instead of fixedly engaging with float 210 itself).

Arm 239 may extend substantially downward from mechanism 235's upper surface until bending and substantially rising back up thereby forming latch or flange surface 238 disposed in front of corresponding flange surface 229. Flange surface 229 may be similar in construction and scale as corresponding surface 238. This elbow of arm 239 provides a bias force that causes arm 239 to naturally return to a pre-flex position (e.g. spring back into place) if a pushing force similar to the arrow of FIG. 10C is applied to surface 229 mechanism 235 is already received by pocket 222 through slots 234 and guides 224. Associated locking members 236 now positioned on the upper surface of lock mechanism then engage with corresponding grooves 257. Having been slidably received by float 210, mechanism 235 in this embodiment fixedly engages directly with grooves 257 by pushing surface 229 towards surface 238 of arm 239. Arm 239 in turn flexes until engaging with corresponding groove 255.

FIG. 10C depicts a close up perspective view specifically of features of mechanism 235 in a fixed engagement orientation. In this respect, the corresponding force represented by the arrow has been applied to surface 229. Since mechanism 235 is in communication with rail 255 through members 236 and in communication with float 210 through slots 234, mechanism 235 is caused to translate forward until the forward face of mechanism 235 contacts the aft portion of pocket 222 so that arm 239 flexes causing surfaces 229 and 238 to contact each other. Flexing arm 239 in this respect also causes surface 238 to communicate with groove 257. The bias force of arm 239 functions to maintain the fixed engagement of surface 238 with corresponding groove 257. In turn, since float 210 is engaged with both mechanism 235 and rail 255, the height of float 210 is maintained at its required height setting.

Figure 11C:
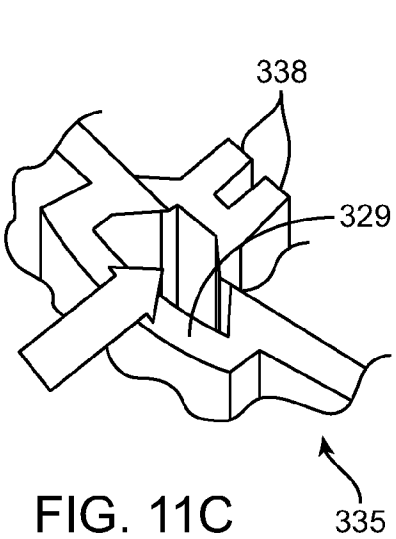
FIGS. 11A, 11B, and 11C depict related perspective views of another lock mechanism.
Figure 11B:
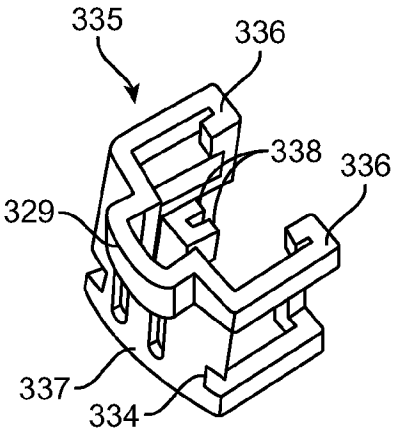
Figure 11A:
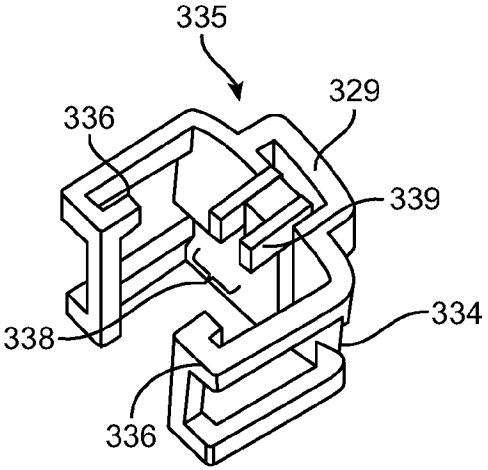

FIGS. 11A, 11B and 11C depict related perspective views of another lock mechanism 335 configured to fix the height of a corresponding float 310 when installed on rail 355 (each of float and rail are not depicted but are similar in design and scope to previously described floats and rails). Mechanism 335 differs from previously described mechanisms 35, 35*b*, 135, and 235 with respect to latching surface 338 of arm 339 and corresponding flange surface 329.

As can be seen, mechanism 335 comprises a plurality of coupling surfaces 338 configured to fixedly engage with associated grooves 357 of rail 355. Arm 339 is configured to flex when the forward face of surface 338 is contacted since arm 339 can translate into the space positioned in the pocket formed by handle 329. Specifically, each of surfaces 338 are designed to grasp onto and substantially encircle corresponding projections or tab of groove 357 in order fixedly engage mechanism 335 to rail 355. Surface 338 form a shoulder or flange surface and arm 339 may comprise a bias force that causes a resistance force to be delivered from surface 338 when groove 357 contacts surface 338. Further, surfaces 338 may also flex laterally towards each other to "clamp" or otherwise grasp or snap onto groove 357 in a fixed engagement.

FIG. 11C specifically depicts a close up perspective view of features of mechanism 335 when in a fixed engagement. In this respect, the pushing corresponding force represented by the arrow has been applied to surface 329. Since mechanism 335 is in communication with groove 357 of rail 355 through locking members 336 (positioned on the forward mating surface of mechanism 235 similar to previously described members 236) and in communication with float 310 through slots 334, mechanism 335 may translate forward due to the pushing force until the forward face of mechanism 335 contacts the aft portion of pocket 322 so that arm 339 flexes backwards towards surface 329. Flexing arm 339 in this manner causes surface 338 to fixedly engage with corresponding groove 357. The bias force of arm 339 functions to maintain the fixed engagement of surface 338 with corresponding groove 357. In turn, since float 310 is engaged with both mechanism 335 and rail 355, the height of float 310 is maintained at its required height setting.

Figure 12:
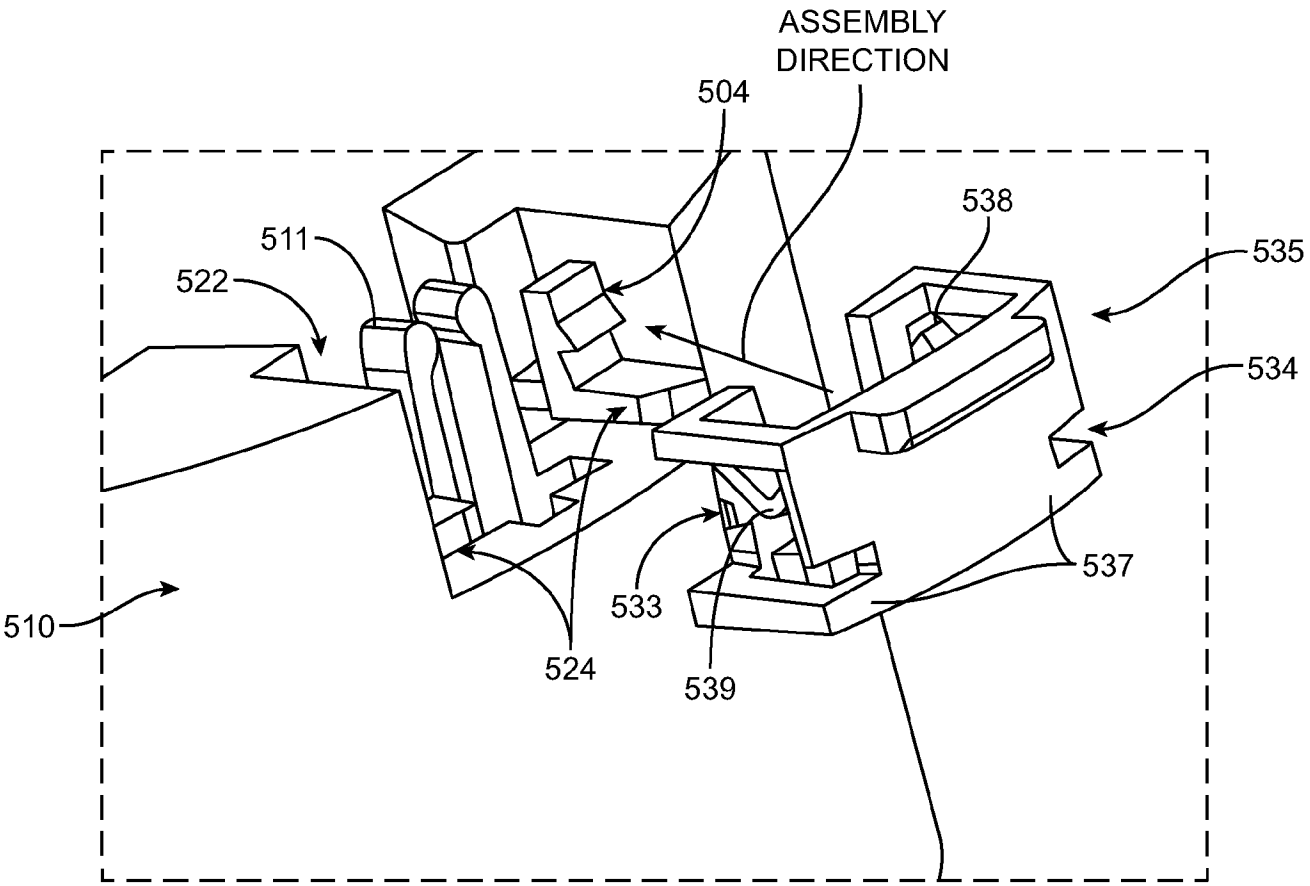
FIG. 12 depicts a perspective view of another lock mechanism for a float in an exploded state prior to being assembled.

FIGS. 12-15 depict another embodiment similar to those described in FIGS. 3-7. Specifically, FIG. 12 depicts a close up perspective view of another lock mechanism 535 and float 510 prior to be assembled in an exploded state. Accordingly, mechanism 535 is slidably received by float 510 at corresponding mating pocket 522 along the assembly direction indicated with the arrow. Once float 510 has been positioned on rail 555 (not depicted but similar in design to previously disclosed guide rails 55, 55*b*, 155, 255, 355 and 455) at the desired height, mechanism 535 fixedly engages with float 510 and rail 555 by flexing arms 539 and positioning locking teeth 532 is discussed more particularly below.

Figure 13:
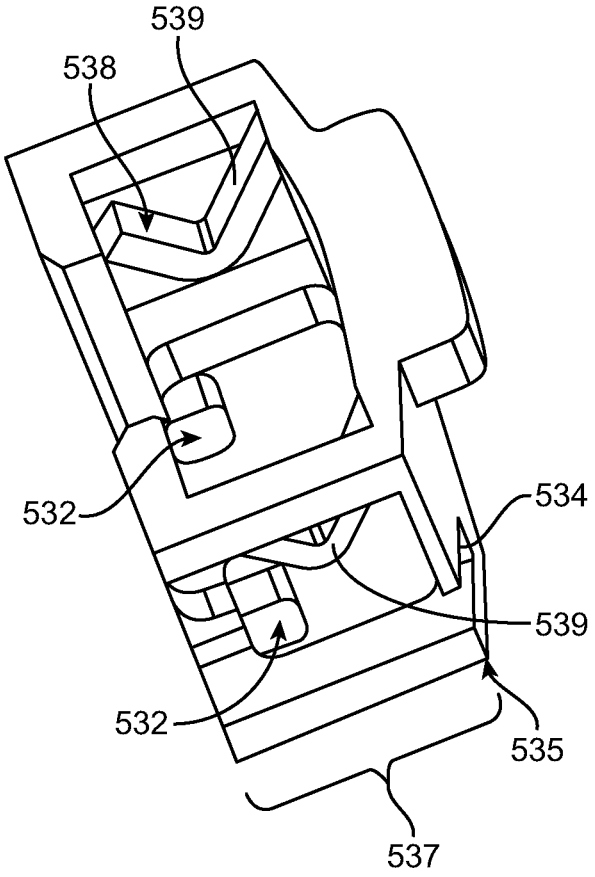
FIG. 13 depicts a close-up perspective view of the lock mechanism depicted in FIG. 12.

Turning to FIG. 13, mechanism 535 is depicted in a perspective view oriented so that locking teeth 532 as well as corresponding bias arms 539, among other features, can be seen. Locking teeth 532 may be positioned adjacent to or near the forward mating surface of mechanism 535 and in the same plane as base 537. Teeth 532 may be projections or members that extend from the forwarding meting surface towards slot 534 to engage corresponding groove 357 of rail 355. Once the desired height of float 510 has been achieved by sliding the float 510 along rail 555, each of teeth 532 communicate with rail 355 through corresponding groove 357 so that arm 339 moves or otherwise flexed until fixedly engaging with tab 504.

Mechanism 535 may optionally comprise a stop tab 533 positioned adjacent to or near the forward mating face of mechanism 535 and above each of teeth 532 so that after mechanism 535 has been fixedly engaged with float 510 and rail 555, tab 533 maintains float 510 and mechanism 535 together in fixed engagement. In this respect, tab 533 is configured so that it projects from the forward mating surface of mechanism and is aligned in the same or similar plane as arm 539 so that it can prevent arm 539 from slipping out of fixed engagement with float 510.

Figure 14:
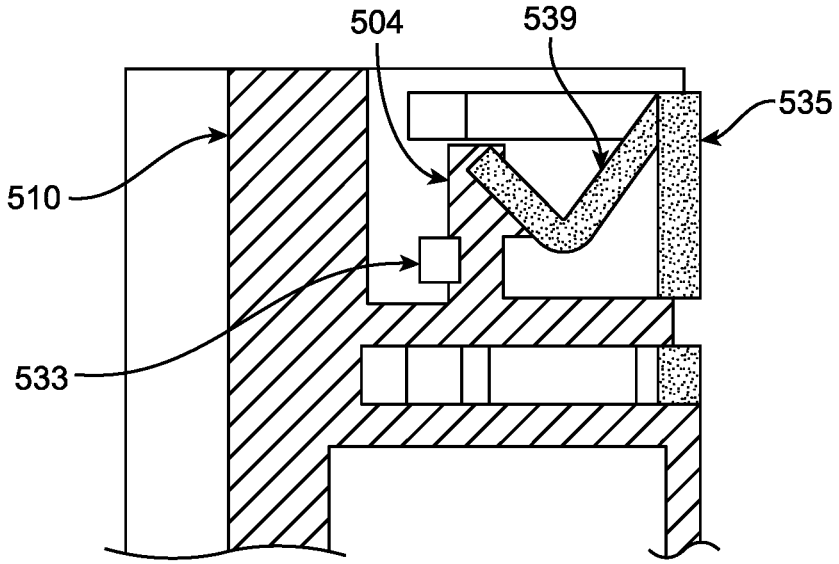
FIG. 14 is a side cross section of the lock mechanism of FIG. 12 when engaged with the float showing how the internal features interact with each other prior to fixedly engaging
Figure 15B:
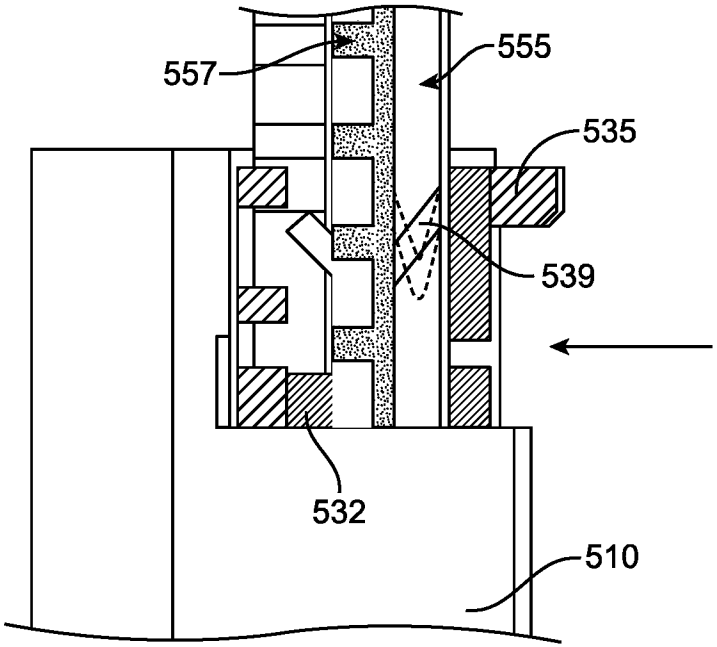
FIGS. 15A and 15B depict related cross-section views of the lock mechanism of FIG. 14 when slidably coupled to the float illustrating how the internal features of each interact in various positions when engaged with the lock mechanism and the rail guide.
Figure 15A:
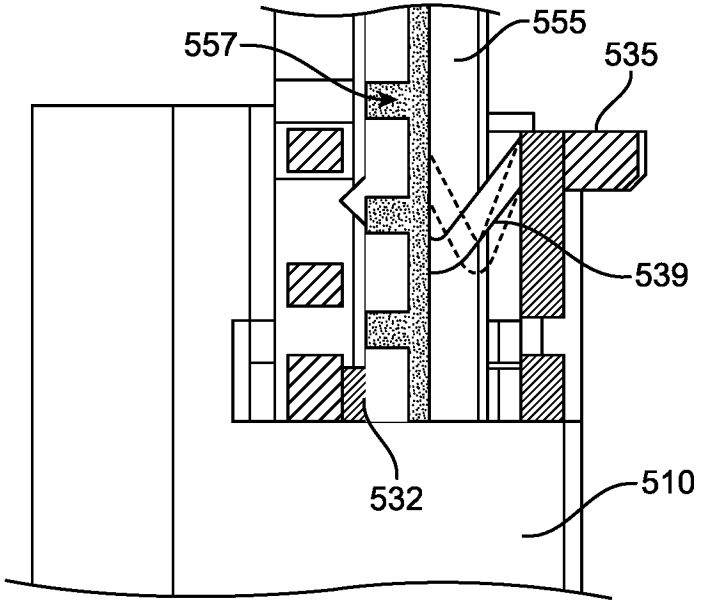

FIG. 14 depicts a close-up side view of a cross-section of the system of FIGS. 12-15 along tooth 532 and arm 539 prior to arm 539 fixedly engaging with receiver 504 (with corresponding tab) to more clearly depict how internal features of both float 510 and mechanism 535 interconnect when fixedly engaging. FIGS. 15A and 15B similar depict side cross-section views of the system of FIG. 12-15 taken along tooth 532 and arm 539 prior to fixed engagement. As evidenced by the vector force arrow of FIG. 15B, an externally applied pushing force to the external surface of mechanism 535 (surface opposite the forward mating surface of mechanism 535) can effectively flex arms 539 into place and fixedly attach to arm receiver 504 of float 510 or otherwise engage or pass corresponding groove 557 of guide 555. Teeth 532 can be seen in both views seated on the lower surface of pocket 522 and engaged with rail 555. As mechanism 535 is pushed in FIG. 15B, mechanism 535 is slid towards float 510 until it contacts tab 533 and arm 539 fixedly engages to float 510 by flexing and/or snapping into or otherwise engaging with tab 504 of float 510.

Figure 16A:
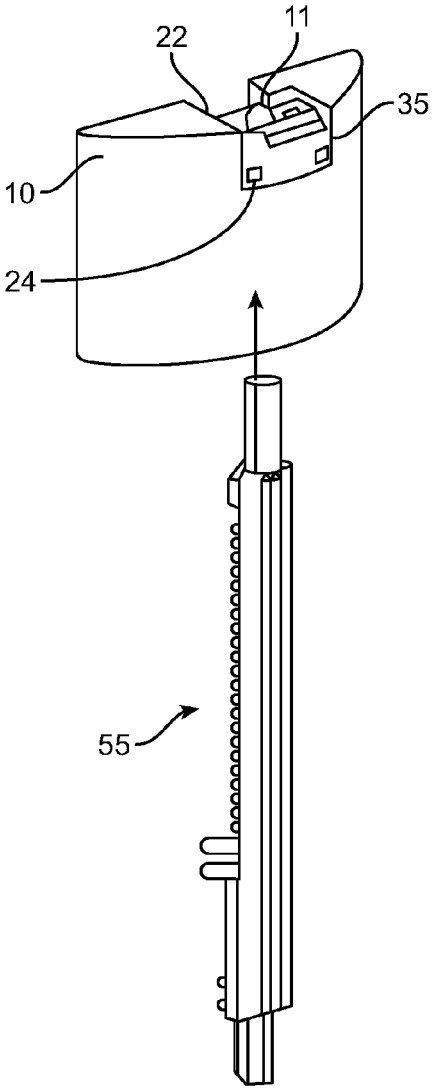
FIGS. 16A and 16B depict related perspective views of a float mechanism when assembled with the lock mechanism and the slide rail of FIGS. 3-6.
Figure 16B:
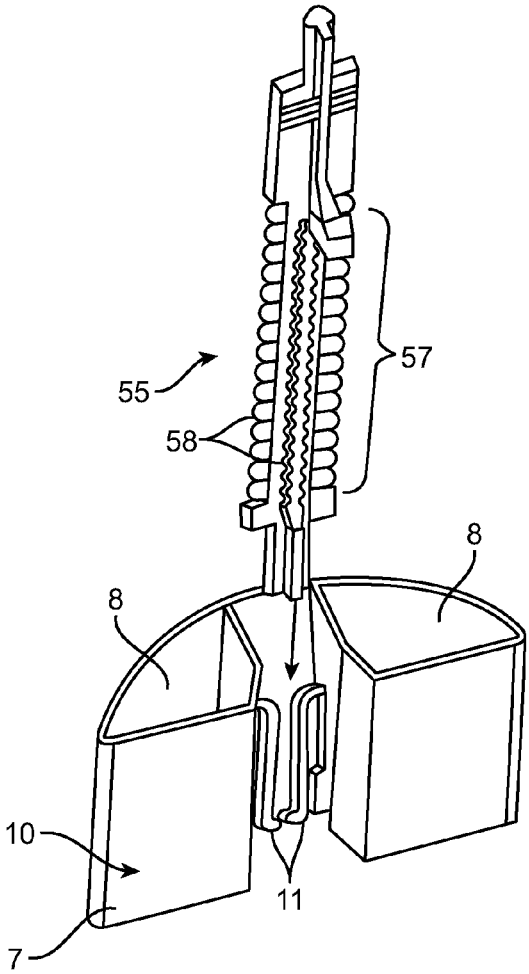

FIGS. 16A and 16B depict related perspective views of embodiments of the float 10 and mechanism 35 of FIGS. 3-6 depicted in an exploded state prior to being arranged with rail guide 55 simply for illustrative purposes. The thick arrow in both views is included to show the which way the system once assembled would be facing. As can be seen, float 10 is slidably coupled to rail 55 so that it can translate between one or more fixed positions defined by the one or more grooves, ridges, or projections 58.

Many alterations and modifications may be made by those having ordinary skill in the art without departing from the spirit and scope of the embodiments disclosed and described herein. Therefore, it is understood that the illustrated and described embodiments have been set forth only for the purposes of examples and that they are not to be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A flush valve system, comprising:

a rail guide;

a float movably coupled to the rail guide, wherein the float is configured to be received by a reservoir, the float having a mating pocket in a side thereof; and a lock mechanism movably received by the mating pocket in the side of the float, the lock mechanism comprising:

one or more bias arms to engage the lock mechanism to the float; and one or more locking members to engage the lock mechanism to the rail guide, wherein the lock mechanism is separate from the float and is fixed in permanent position when received into the mating pocket in the side of the float, and wherein the locking members project in the same direction into the mating pocket and wherein the rail guide is positioned between the locking members and the locking members are positioned between opposing sides of the mating pocket.

2. The system according to claim 1, wherein the lock mechanism when received by the float is slidable along the rail guide between one or more positions.

3. The system according to claim 1, wherein the rail guide further comprises a first plurality of ridges or notches, wherein a height of the float with respect to the rail guide is adjustable by sliding the float along the first plurality of ridges or notches.

4. A flush valve system, comprising:

a rail guide;

a float movably coupled to the rail guide, wherein the float is configured to be received by a reservoir, the float having a mating pocket; and a lock mechanism movably received by the mating pocket of the float, the lock mechanism comprising:

one or more bias arms to engage the lock mechanism to the float; and one or more locking members to engage the lock mechanism to the rail guide wherein the rail guide further comprises a first plurality of ridges or notches and a second plurality of ridges or notches, wherein a height adjustment guide of the mating pocket removably attaches to the first plurality of ridges or notches when sliding the float along the first plurality of ridges or notches, and wherein the one or more locking members of the lock mechanism fixedly engages with the rail guide.

5. The system according to claim 4, wherein each of the one or more bias arms further comprises a bias force, and wherein the lock mechanism and the float are fixedly engaged when the bias force of the one or more bias arms causes the one or more bias arms to communicate with a tab of the float.

6. The system according to claim 5, wherein each of the one or more bias arms flexes inwardly or outwardly when communicating with the tab.

7. The system according to claim 5, wherein each of the one or more bias arms further comprises a latch surface that communicates with the tab.

8. The system according to claim 5, wherein the lock mechanism further comprises an external surface opposite the rail guide, wherein the lock mechanism is configured so that a predetermined pushing force externally applied to the external surface permanently fixedly engages the lock mechanism with the tab.

9. The system according to claim 8, wherein the lock mechanism is slidable along the rail guide prior to being permanently fixedly engaged with the float after being received by the mating pocket of the float.

10. The system according to claim 5, wherein the bias arm is arranged so that a predetermined force externally applied to the bias arm permanently fixedly engages the lock mechanism with the float.

11. The system according to claim 10, wherein the predetermined force is substantially normal to the closed upper surface of the float, and wherein the predetermined force to permanently fixedly engage the lock mechanism with the float is applied using a tool.

12. A flush valve system, comprising:

a rail guide;

a float movably coupled to the rail guide, wherein the float is configured to be received by a reservoir, the float having a mating pocket; and a lock mechanism movably received by the mating pocket of the float, the lock mechanism comprising:

one or more bias arms to engage the lock mechanism to the float; and one or more locking members to engage the lock mechanism to the rail guide, wherein the lock mechanism further comprises one or more guide slots corresponding to one or more lock mechanism guides of the mating pocket, wherein the lock mechanism guides of the mating pocket are slidably inserted into the one or more guide slots of the lock mechanism when the lock mechanism is slidably coupled to the mating pocket.

13. A method of maintaining a height of a float in a flush valve system in a toilet tank, comprising:

inserting a lock mechanism into a mating pocket in the side of the float movably coupled to a guide rail in the system;

positioning the float along the guide rail until a predetermined height; and engaging the lock mechanism to the float and the guide rail, wherein the lock mechanism is separate from the float and is fixed in permanent position when received into the mating pocket in the side of the float, and wherein one or more locking members on the lock mechanism project in the same direction into the mating pocket and wherein the rail guide is positioned between the locking members and the locking members are positioned between opposing sides of the mating pocket.

14. The method according to claim 13, wherein the predetermined height corresponds to a predetermined flush volume associated with the float.

15. A method of maintaining a height of a float in a flush valve system in a toilet tank, comprising:

inserting a lock mechanism into a mating pocket of the float movably coupled to a guide rail in the system;

positioning the float along the guide rail until a predetermined height; and engaging the lock mechanism to the float and the guide rail, wherein the lock mechanism further comprises an external surface opposite the mating pocket and one or more bias arms that extend from the external surface towards the mating pocket, wherein the lock mechanism fixedly engages with the float by flexibly moving the one or more bias arms until positioned underneath or in communication with corresponding tabs of the float.

16. The method according to claim 13, wherein the rail guide further comprises a longitudinal slide axis and one or more ridges onto which each of the one or more members couples to the rail guide, wherein each of the one or more ridges of the rail guide comprises an array of teeth that extend outwardly from the rail guide to fixedly engage with the float, lock mechanism, or both, wherein the array of teeth or projections are snapped into or positioned on the float or lock mechanism.

* * * * *